United States Patent [19]

Anderson

[11] 4,082,259

[45] Apr. 4, 1978

[54] CYLINDER FOLDER

[75] Inventor: Robert John Anderson, Dayton, Ohio

[73] Assignee: Harris Corporation, Cleveland, Ohio

[21] Appl. No.: 748,764

[22] Filed: Dec. 8, 1976

[51] Int. Cl.[2] ..... B65H 45/16

[52] U.S. Cl. ..... 270/73

[58] Field of Search ..... 270/73, 69, 79, 61 F

[56] References Cited

U.S. PATENT DOCUMENTS

| | | | |
|---|---|---|---|
| 3,250,528 | 5/1966 | Loose | 270/73 |
| 3,991,994 | 11/1976 | Farish | 270/73 |

*Primary Examiner*—Edgar S. Burr
*Assistant Examiner*—A. Heinz
*Attorney, Agent, or Firm*—Biebel, French & Nauman

[57] ABSTRACT

In a cylinder folder for zig-zag folding a flexible web, air moves through openings in the walls of both cylinders to equalize and relieve pressure in the region between the web and the cylinders where the web is separated from the cylinders and laid down on the zig-zag stack. The air moves through the cylinder wall openings from the hollow cylinder interiors, which communicate with the ambient atmosphere through openings in the end walls of the cylinders.

1 Claim, 3 Drawing Figures

CYLINDER FOLDER

CROSS REFERENCE TO RELATED APPLICATIONS

Reference is made to co-pending U.S. application Ser. No. 730,439, filed Oct. 7, 1976.

BACKGROUND OF THE INVENTION

The present invention relates to folding apparatus, and more particularly to cylinder zig-zag folders such as described in U.S. Pat. No. 3,250,528, issued May 10, 1966 and assigned to the assignee of the present invention. Such folders use a pair of driven cylinders which are mounted with their axes of rotation in parallel adjacent relation. The outer cylindrical walls of the cylinders define a nip which receives the web, and gripper and tucker blades in the cylinder walls alternately fold and draw the web from the nip to deposit it in zig-zag fashion in a stack beneath the cylinders on a moving delivery table.

Folding machines such as that described in the above U.S. Pat. No. 3,250,528 have satisfactorily and accurately folded continuous, cross perforated webs at very high speeds. Further, since the principal motions are rotary, with very little reciprocating action, the theoretical maximum speed of operation would seem to be almost without limit. Limitations are imposed, however, by the paper web itself, since at higher speeds it tends to cling to the surfaces of the cylinders. This problem is solved in part by the use of stripping pins, such as the stripping pins 87 shown in the above-noted U.S. Pat. No. 3,250,528, which help separate the web from the cylinders. However, at higher speeds the tendency of the web to cling to the cylinders can still "bunch" or curl it in the vicinity of the stripping pins.

U.S. Pat. No. 3,980,291, issued Sept. 14, 1976 and assigned to the assignee of the present invention, discloses a cylinder folder construction which improves separation of the web from the cylinders with a series of spaced apart shallow recesses formed around each cylinder surface. The recesses have bottoms slightly depressed with respect to the outer cylindrical walls and are separated by relatively narrow ribs which contact the web and form the sides of the recesses. The area of actual contact between the web and the cylinders is thereby substantially reduced, resulting in a considerably reduced tendency for the web to cling to the cylinder surfaces. The recesses also trap and pressurize air therein, between the cylinders and the web, aiding the subsequent separation thereof.

Nevertheless, while the above inventions have successfully folded continuous webs at increased speeds, a need still remains to operate such folders at even greater speeds. Not only does this call for even better web separation from the cylinders, but also for better and more rapid stack formation. At such speeds the stack tends to "float" on air trapped between the folds, and to be held up by the lack of air above as the stack tries to settle. Sometimes this causes jams or irregular stacks as the folds float too close to the cylinders, or slip over one another on the air cushions between them. Room thus remains for improving still further the separation of the web from the surfaces of the cylinders and for facilitating proper and rapid stack formation as the web is being deposited at high speed in the zig-zag stack on the delivery table.

SUMMARY OF THE INVENTION

Briefly, the present invention provides for a positive flow or movement of air between the web and the cylinders at the region where the web is being stripped from the cylinders and laid onto the zig-zag stack. The air is separately available, and is independent of the surface contours of the cylinders themselves. The air is provided and injected principally into and at the site of the gap on each cylinder between it and the folded web as the stripping pins engage the folded web and separate it from the cylinders. This separately provided air, which was not previously present, equalizes pressure, both positive and negative, helping for example to break the vacuum which tends to form between the web and the cylinder as the stripping pins deflect the web from the cylinder. The air flows where needed, relieving positive pressures beneath a fold which is being lowered, and relieving negative pressures above that same fold. The cylinder will then tend much less to "overdrive" the web causing it to "bunch" or curl in the vicinity of the stripping pins, and the web will settle quickly and properly onto the stack.

In the preferred embodiment, openings pass through the cylinder walls form the hollow interiors of the cylinders into the bottoms of the recesses. The ends of the cylinders are also open, providing passageways through the cylinder ends into the hollow cylinder interiors, which in turn communicate with the cylinder recesses through the openings through the cylinder walls. Thus, as the cylinders are rotated, they effectively pass air in whichever direction is necessary from the surrounding atmosphere through the cylinder ends into the interiors of the cylinders, and then outwardly through the openings through the cylinder walls, passing the air through the bottoms of the recesses. No external provision is therefore required for supplying the air. Instead, the cylinders are self-compensating as they are rotated, automatically moving the appropriate amounts of air in the region between the web and the cylinders and the web stack for aiding the release of the web as it is engaged by the stripping pins and equalizing and relieving pressure in this region as the web is being delivered to and formed into the zig-zag folded stack.

It is therefore an object of the present invention to provide an improved cylinder folded construction; a cylinder folder providing for a flow of air in both cylinders between the region between the cylinders, the web, and the web stack as it is engaged by the stripper means and formed into the zig-zag stack; in which the air moves through openings through the cylinder wall; and which will provide for substantial increases in operating speeds for such folders in an economical, reliable, and durable fashion.

Other objects and advantages of the invention will be apparent from the following description, the accompanying drawings and the appended claims.

DESCRIPTION OF THE PREFERRED EMBODIMENT

Figure 1:
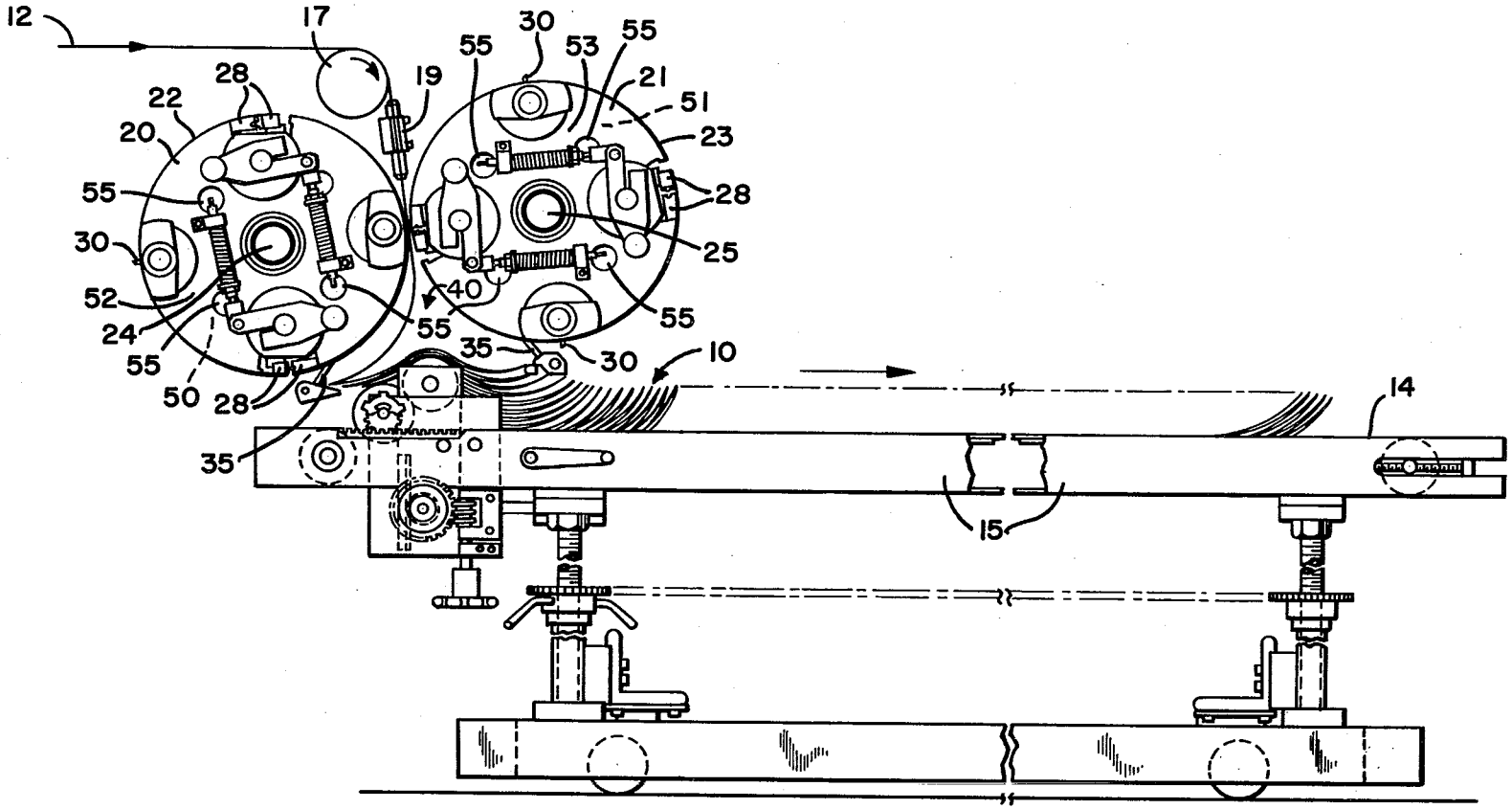
FIG. 1 is a somewhat schematic elevational view of a cylinder web folding apparatus incorporating the present invention.

Referring to the drawings, which illustrate a preferred embodiment of the present invention, FIG. 1 shows, in a somewhat schematic manner, the overall construction and arrangement of the folding apparatus and the path of the continuous zig-zag folds 10 of a web 12 as the folds are delivered along the supporting top 14 of a delivery table, generally referred to as 15.

In FIG. 1, the web 12 of paper is shown entering the folding machine in the upper left-hand corner as it is received from a printing press, or the like, and is directed over a power-driven roller 17 downwardly into a feed chute 19. Commercial machines of this type are usually designed for processing single layer webs, although it is conceivable that the web could be several webs overlaid on top of one another, as is commonly used to form multiple-copy business forms. Either way, the webs usually have uniformly spaced perforations which lie transversely across the web. The cross perforations allow one form to be separated from an adjacent form, and are the lines on which the web is commonly zig-zag folded.

A pair of folding cylinders 20 and 21 having outer cylindrical walls 22 and 23, respectively, are driven and supported on parallel drive shafts 24 and 25, with their axes of rotation in parallel adjacent relation. The drive shafts are supported in the side frames (not shown) of the folding apparatus in conventional fashion. The cylinders 20 and 21 and their cylindrical walls 22 and 23 are counter-rotated at identical peripheral speeds. The cylinders define a nip which receives the web from the feed chute 19 on its way down to the top 14 of the delivery table 15.

Mounted longitudinally and diametrically opposite on each cylinder are pairs of folding jaws or grippers 28 which open and close in known fashion as the cylinders 20 and 21 are counter-rotated by their power source (not shown). Spaced 90° from the grippers 28 are longitudinally disposed pivotable tucker blades 30. The lengthwise mounted grippers 28 and tucker blades 30 are mounted in the walls 22 and 23 of the cylinders with each gripper on one cylinder being arranged in opposed gripping relation with a blade on the other cylinder, and vice versa, in known fashion. As the cylinders rotate, the blades 30 alternately tuck the web 12, preferably at the cross perforations, into the grippers on alternate cylinders, and thus at longitudinally spaced intervals along the web. The grippers 28 then close on the web, and the grippers are controlled in known fashion such that lengths of the web are pulled away from the nip and held by the grippers in contact with portions of the associated outer cylindrical walls 22 or 23. As each gripper 28 rotates to a position opposite table 15, it opens, releasing the web. In this way, the web is held in contact with a portion of the outer cylindrical wall of first one and then the other of the cylinders 20 and 21, and then released in this alternating fashion by the grippers 28, to form the zig-zag folds 10 of the web 12.

In operation, the grippers open slightly before they are rotated to positions opposite the delivery table 15, so that as the web folds engage a series of stripping pins 35 the pins assist in removing the web from contact with the outer cylindrical walls 22 and 23. The stripping pins 35 extend from outside the cylinders into recesses 37 in the outer cylindrical walls 22 and 23, and are positioned and operative to guide the folded web from the grippers and cylinders.

The recesses 37 form a series of spaced apart shallow recesses opening outwardly in a circumferential direction around each cylinder, and have bottoms slightly depressed with respect to the outer cylindrical walls 22 and 23. The recesses are separated by relatively narrow ribs 38 which contact the web 12 and form the sides of the recesses 37. As may be seen in FIG. 2, the area of contact between the outer cylindrical walls 22 and 23 and the web 12 is thus limited to the small area of the ribs 38. This limited area of contact reduces the tendency of the web to cling to the cylinders after the web is released by the gripper 28 and engaged by the stripping pins 35.

Figure 2:
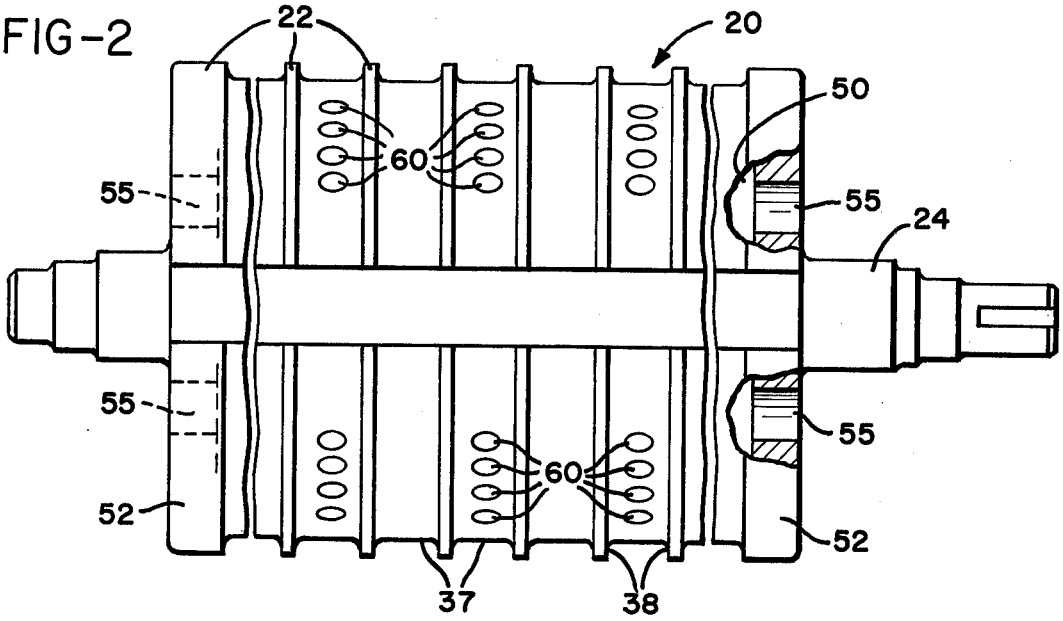
FIG. 2 is a plan view of the left-hand folder cylinder.
Figure 3:
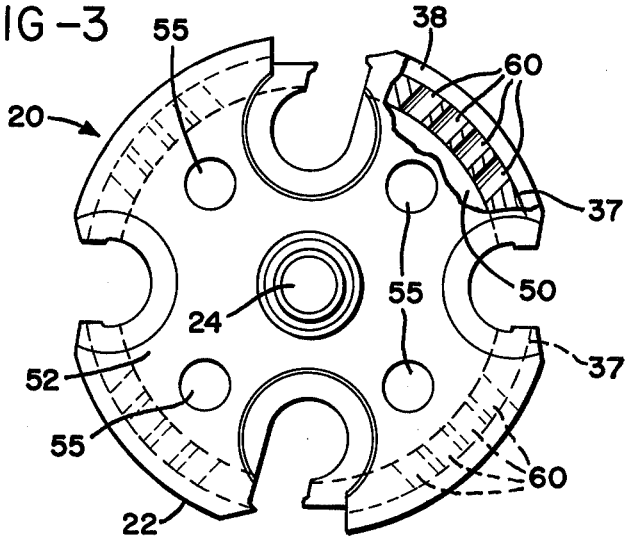
FIG. 3 is a partially broken away end view of the cylinder illustrated in FIG. 2.

Although the broad recesses 37 and narrow ribs 38 facilitate release of the web 12 from the outer cylindrical walls 22 and 23, it has been found that at higher operating speeds a more satisfactory zig-zag folded web and stack 10 can be provided if the stripping pins 35 are further aided in removing the web 12 from the cylinders, and if provision is made for equalizing pressure within the region 40 between the nip, the web stack, and the cylinders, as the web is being laid down onto the stack. Thus, as illustrated in FIGS. 2–3, the cylinders provide for a flow of air into and out of their recesses 37 as the folded web is released by the grippers 28, guided from the cylinders by the stripping pins 35, and formed into the stack 10. This supply of air into the region between the web, the cylinders, and the stack aids the release of the web as it is engaged by the stripping pins and equalizes and relieves pressure in this region as the web is being delivered to and formed into the zig-zag folded stack.

The cylinders 20 and 21 automatically provide their own supplies of air into and out of the recesses 37. The cylinders 20 and 21 have hollow interiors 50 and 51 respectively, and the ends 52 and 53 of the cylinders 20 and 21 have passageways 55 therethrough which place the interiors 50 and 51 thereof in communication with the surrounding atmosphere. The cylinder walls 22 and 23 have openings 60 which pass through the cylinder walls from the hollow cylinder interiors 50 and 51 into the bottoms of the recesses 37, placing the recesses in communication with the cylinder interiors, and these in turn with the ambient atmosphere.

As illustrated in FIG. 2, it has been found that it is preferable to distribute the openings across and around each of the cylinders, but it is not ordinarily necessary to provide openings 60 into all of the recesses 37. Rather, selected recesses may be so equipped, depending upon the nature of the web 12, the size and operating speeds of the folding cylinders 20 and 21, and the particular applications thereof. Variations may therefore be made within the scope of the present invention, according to the particular application at hand.

As may be seen, therefore, the present invention provides numerous advantages. Principally, the present invention provides for substantial increases in the operating speeds of cylinder folders, with inexpensive and easily provided improvement thereto. As shown and described, both of the cylinders are provided with openings connecting their cylinder recesses to the interiors of the cylinders and from there to the atmosphere. This facilitates release of the web from the outer cylinder surfaces as the web is engaged by the stripping pins, and provides for a flow of air to equalize and relieve pressure at each cylinder and each side of the web stack to facilitate the rapid and proper formation thereof. The invention is thus inexpensive, easy to fabricate, and readily adaptable to many of the most popular existing cylinder folder configurations.

While the form of apparatus herein described constitutes a preferred embodiment of this invention, it is to be understood that the invention is not limited to this precise form of apparatus, and that changes may be made therein without departing from the scope of the invention.

What is claimed is:

1. In a high speed cylinder type folder for folding a continuous web in zig-zag fashion, the folder including a pair of substantially hollow driven cylinders having outer cylindrical walls and being mounted with their axes of rotation in parallel adjacent relation, the walls defining a nip adapted to receive the web therebetween, grippers and tucker blades mounted lengthwise in the walls of each cylinder, each gripper on one cylinder being arranged in opposed cooperating relation with a blade on the other cylinder, and vice versa, whereby the blades alternately tuck the web into the grippers on alternate cylinders at longitudinally spaced intervals along the web in response to rotation of the cylinders, the grippers being controlled such that lengths of the web are pulled away from the nip and held by the grippers in contact with portions of the associated outer cylindrical walls of first one and then the other of the cylinders before release of the grippers, and stripper means operative to guide the folded web from the grippers and cylinders upon release of the grippers, the portions of the outer walls having formed therein a series of spaced apart shallow recesses opening outwardly in a circumferential direction around each cylinder and having bottoms slightly depressed with respect to the outer cylindrical walls, the recesses being separated by relatively narrow ribs which are adapted to contact the web and which form the sides of the recesses, the improvement comprising:

means defining openings communicating through the walls of both cylinders from the hollow interiors thereof into the bottoms of the recesses, said openings being distributed across and around each cylinder to provide for a flow of air through said openings in the region between the nip between the cylinders, the web and the web stack for aiding the release of the web as it is engaged by the stripper means and for equalizing and relieving pressure in said region as the web is being delivered to and formed into the zig-zag folded stack, and means providing passageways through the cylinder ends placing the hollow interiors thereof in communication with the surrounding atmosphere for connecting the cylinder interiors to ambient pressure and facilitating the movement of air through said end passageways and through said cylinder wall openings as the cylinders are rotated.

* * * * *